US012188354B1

(12) United States Patent
Strege

(10) Patent No.: US 12,188,354 B1
(45) Date of Patent: Jan. 7, 2025

(54) RECIPROCATING ENGINE WITH RECIPROCATING RACK AND PINION

(71) Applicant: Vernon L. Strege, Valparaiso, IN (US)

(72) Inventor: Vernon L. Strege, Valparaiso, IN (US)

( * ) Notice: Subject to any disclaimer, the term of this patent is extended or adjusted under 35 U.S.C. 154(b) by 0 days.

(21) Appl. No.: 18/641,673

(22) Filed: Apr. 22, 2024

(51) Int. Cl.
*F01B 9/04* (2006.01)

(52) U.S. Cl.
CPC ..... *F01B 9/047* (2013.01)

(58) Field of Classification Search
CPC ..... F01B 9/047
See application file for complete search history.

(56) References Cited

U.S. PATENT DOCUMENTS

| | | | | |
|---|---|---|---|---|
| 1,384,335 | A * | 7/1921 | Powell | F16H 21/30 74/40 |
| 1,399,666 | A * | 12/1921 | Short | F02B 75/246 74/32 |
| 4,608,951 | A * | 9/1986 | White | F01B 9/047 74/33 |
| 4,864,976 | A * | 9/1989 | Falero | F02B 75/28 123/197.1 |
| 5,351,566 | A * | 10/1994 | Barnett | A61G 5/023 123/197.1 |
| 5,406,859 | A * | 4/1995 | Belford | F01B 9/047 123/197.1 |
| 5,535,715 | A | 7/1996 | Mouton | |
| 8,327,819 | B2 * | 12/2012 | Voegeli | F16J 1/10 123/197.1 |
| 9,765,689 | B1 | 9/2017 | Amplatz | |
| 2010/0139477 | A1 * | 6/2010 | Reed | F01B 9/047 123/197.1 |
| 2019/0360560 | A1 * | 11/2019 | Sanders | F16H 19/02 |
| 2020/0191244 | A1 * | 6/2020 | Zheng | F02B 75/24 |

FOREIGN PATENT DOCUMENTS

| | | | | |
|---|---|---|---|---|
| CN | 1430003 | | 7/2003 | |
| CN | 1749568 | | 3/2006 | |
| CN | 101128659 | B * | 5/2010 | F01B 9/047 |
| CN | 103775205 | A * | 5/2014 | F01B 1/08 |
| CN | 104500667 | | 4/2015 | |
| CN | 105298639 | | 2/2016 | |
| CN | 110410475 | | 11/2019 | |
| CN | 111472887 | | 7/2020 | |
| CN | 212202245 | | 12/2020 | |
| KR | 20210080497 | A * | 6/2021 | F01B 9/047 |
| WO | WO9000676 | A1 * | 1/1990 | F01B 9/047 |

(Continued)

OTHER PUBLICATIONS

Machine Translation of CN103775205A PDF File Name: "CN103775205A_Machine_Translation.pdf".*

(Continued)

*Primary Examiner* — Grant Moubry
*Assistant Examiner* — Ruben Picon-Feliciano
(74) *Attorney, Agent, or Firm* — Hartman Global IP Law; Gary M. Hartman; Domenica N. S. Hartman

(57) ABSTRACT

Reciprocating engines and methods of their operation of. Pistons of such an engine are interconnected through a pinion gear and dual gear rack of a reciprocating assembly in a manner capable of reducing the loss of torque at the top-dead-center (TDC) positions of the pistons.

16 Claims, 4 Drawing Sheets

(56) References Cited

FOREIGN PATENT DOCUMENTS

| | | | | |
|---|---|---|---|---|
| WO | WO-2005111375 | A1 * | 11/2005 | ..... F01B 9/042 |
| WO | WO-2006126909 | A1 * | 11/2006 | ..... F01B 9/047 |

OTHER PUBLICATIONS

Machine Translation of CN101128659B PDF File Name: "CN101128659B_Machine_Translation.pdf".*
Machine Translation of KR20210080497A PDF File Name: "KR20210080497A_Machine_Translation.pdf".*
Machine Translation of WO2005111375A1 PDF File Name: "WO2005111375A1_Machine_Translation.pdf".*
Machine Translation of WO2006126909A1 PDF File Name: "WO2006126909A1_Machine_Translation.pdf".*

* cited by examiner

RECIPROCATING ENGINE WITH RECIPROCATING RACK AND PINION

BACKGROUND OF THE INVENTION

The present invention generally relates to reciprocating engines. More particularly, the invention relates to reciprocating engines capable of operating with improved efficiencies and power during a stroke of a piston thereof.

Reciprocating engines operate through the action of pistons that are connected to a crankshaft and reciprocate within cylinders. The position of a piston farthest from the crankshaft is known as top-dead-center (TDC, and the position of a piston when closest to the crankshaft is known as bottom-dead-center (BDC). Both positions can generally be referred to as dead center. A characteristic common to the TDC position of a piston is that the force applied to the piston (e.g., as a result of combustion within the cylinder) is through the axis of the connecting rod that connects the piston to the crankshaft, with the result that no torque is transmitted from the piston to the crankshaft. To compensate, reciprocating engines commonly utilize energy stored in a flywheel to overcome the loss of torque at top dead center of its pistons, and multi-cylinder engines are commonly designed so that the top-dead-centers of all pistons do not occur at the same time.

Though the above-noted measures are effective to some degree, it would be desirable if a reciprocating engine were capable of improved power and efficiency by reducing the loss of torque typically associated with pistons at their TDC positions.

BRIEF SUMMARY OF THE INVENTION

The intent of this section of the specification is to briefly indicate the nature and substance of the invention, as opposed to an exhaustive statement of all subject matter and aspects of the invention. Therefore, while this section is intended to be directed to and consistent with subject matter recited in the claims, additional subject matter and aspects relating to the invention are set forth in other sections of the specification, particularly the detailed description, as well as any drawings.

The present invention provides, but is not limited to, reciprocating engines and methods of their operation.

According to a nonlimiting aspect of the invention, a reciprocating engine includes an engine mainframe including an upper wall, a lower wall, a first sidewall, and a second sidewall defining an interior chamber of the engine mainframe. An output shaft extends through the interior chamber and is adapted for rotation within the interior chamber. A pinion gear is coupled to the output shaft for rotation with the output shaft. The pinion gear has teeth disposed on a portion of a circumference of the pinion gear. A timing arm is coupled to the output shaft for rotation with the output shaft. The timing arm has a timing pin disposed at a distal end of the timing arm. A dual gear rack is disposed around the output shaft and the pinion gear and configured to reciprocate within the interior chamber of the engine mainframe. The dual gear rack has oppositely-disposed first and second end plates and first and second gear racks between the first and second end plates. The first and second gear racks each have gear rack teeth configured to mesh with the teeth of the pinion gear. A timing plate is coupled to the dual gear rack for reciprocating therewith. The timing plate defines a timing slot that has an elliptical shape and is engaged by the timing pin of the timing arm as the timing arm rotates with the output shaft. The first gear rack teeth are configured to mesh with the teeth of the pinion gear, causing the output shaft to rotate as the dual gear rack moves towards the upper wall of the engine mainframe, and the second gear rack teeth are configured to mesh with the teeth of the pinion gear of the pinion gear causing the output shaft to continue to rotate as the dual gear rack moves towards the lower wall of the engine mainframe. The timing pin of the timing arm travels within the timing slot as the output shaft rotates.

According to another nonlimiting aspect of the invention, method is provided for operating a reciprocating engine having a dual gear rack configured to reciprocate within an interior chamber of an engine mainframe of the reciprocating engine. The dual gear rack has oppositely-disposed first and second end plates and first and second gear racks between the first and second end plates, the first gear rack has first gear rack teeth, and the second gear rack has second gear rack teeth. The method includes causing a first piston disposed within a first cylinder of the reciprocating engine to reciprocate within the first cylinder and causing a second piston disposed within a second cylinder of the reciprocating engine to reciprocate within the second cylinder. The first and second pistons are coupled to, respectively, the first and second end plates of the dual gear rack to cause the dual gear rack to reciprocate within the engine mainframe. The reciprocating of the dual gear rack within the engine mainframe causes a pinion gear and a timing arm coupled to an output shaft of the reciprocating engine to rotate within the engine mainframe. The pinion gear has teeth that in alternating sequence mesh with the first gear rack teeth of the first gear rack of the dual gear rack as the dual gear rack travels in a first direction and then mesh with the second gear rack teeth of the second gear rack of the dual gear rack as the dual gear rack travels in a second direction. The dual gear rack causes the pinion gear to rotate the output shaft, and the output shaft causes the timing arm to rotate. The timing arm has a timing pin disposed at a distal end thereof, and the timing pin travels within an elliptical-shaped timing slot.

Technical effects of engines and methods as described above include the capability of improving power and efficiency of a reciprocating engine by reducing the loss of torque at the TDC position of a piston of the engine.

Other aspects and advantages will be appreciated from the following detailed description as well as any drawings.

DETAILED DESCRIPTION OF THE INVENTION

Figure 1:
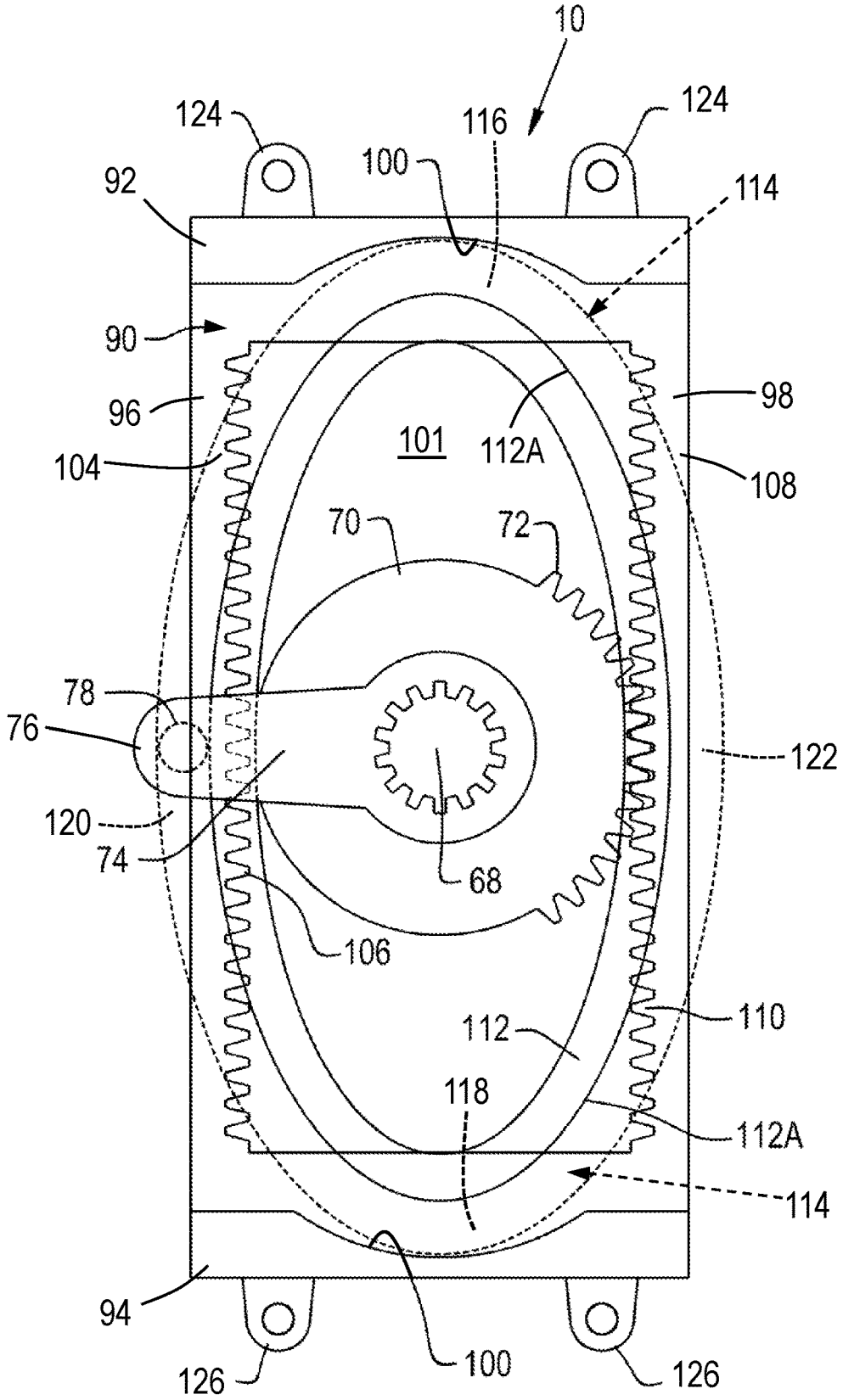
FIG. 1 is a schematic end view of a reciprocating assembly comprising a dual gear rack and pinion gear configured for use within a reciprocating engine in accordance with nonlimiting aspects of the present invention.

The intended purpose of the following detailed description of the invention and the phraseology and terminology employed therein is to describe what is shown in the drawings, which include the depiction of and/or relate to one or more nonlimiting embodiments of the invention, and to describe certain but not all aspects of what is depicted in the drawings, including the embodiment(s) depicted in the drawings. The following detailed description also describes certain investigations relating to the embodiment(s) depicted in the drawings, and identifies certain but not all alternatives of the embodiment(s) depicted in the drawings. As nonlimiting examples, the invention encompasses additional or alternative embodiments in which one or more features or aspects shown and/or described as part of a particular embodiment could be eliminated. Therefore, the appended claims, and not the detailed description, are intended to particularly point out subject matter regarded to be aspects of the invention, including certain but not necessarily all of the aspects and alternatives described in the detailed description.

Figure 2:
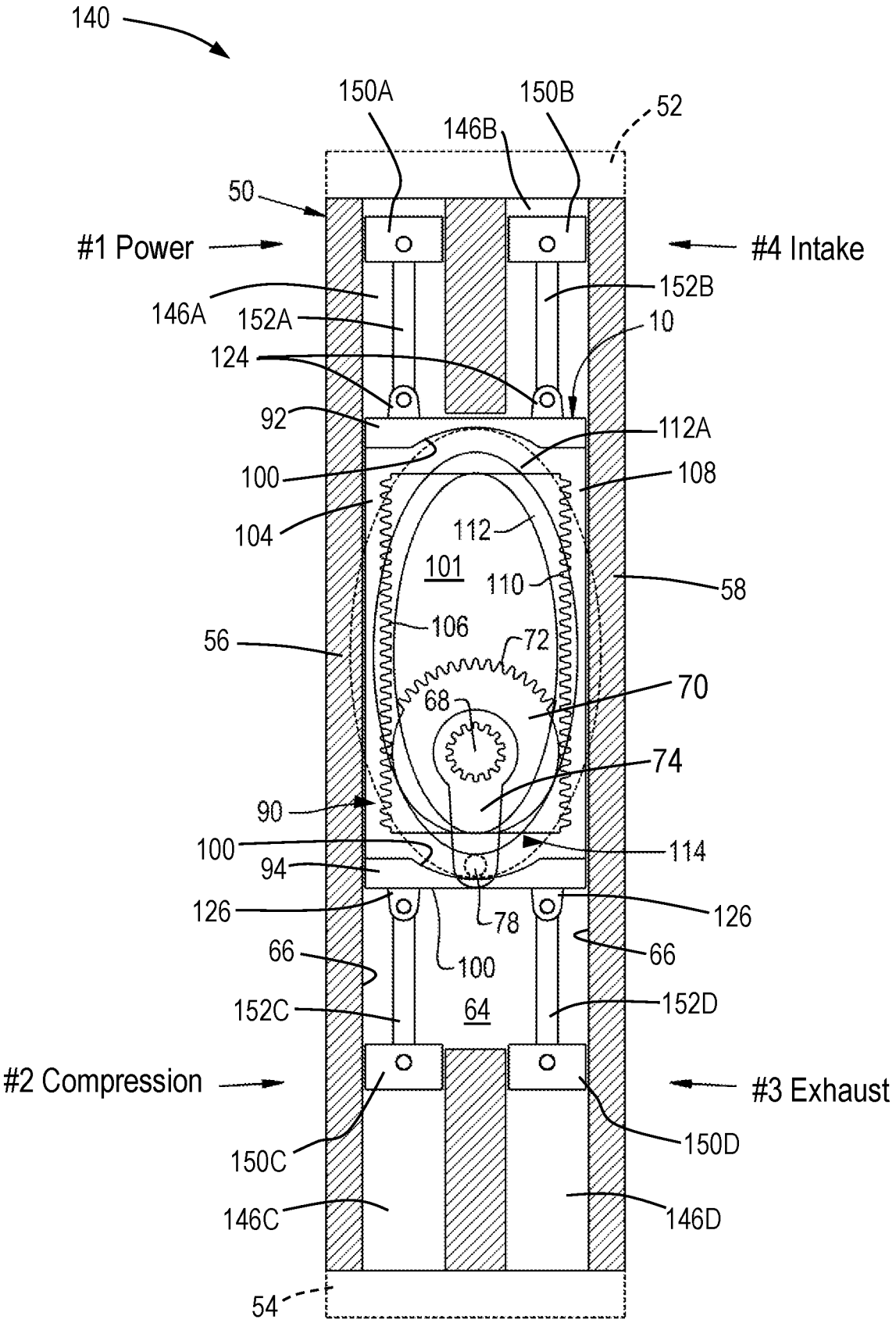
FIGS. 2 and 3 schematically represent a cross-section and a longitudinal section of a reciprocating engine that incorporates the reciprocating assembly of FIG. 1.

FIG. 1 schematically represents a reciprocating assembly 10 adapted for use in a reciprocating engine, such as but not limited to a steam engine or an internal combustion engine, and FIGS. 2 through 4D schematically represent one or more reciprocating assemblies 10 of FIG. 1 disposed within an engine mainframe 50 of a reciprocating engine 140. To facilitate the description provided below of the reciprocating assembly 10 and reciprocating engine 140 represented in the drawings, relative terms, including but not limited to, "proximal," "distal," "vertical," "horizontal," "lateral," "front," "rear," "side," "forward," "rearward," "top," "bottom," "upper," "lower," "above," "below," "right," "left," etc., may be used in reference to the orientation of the reciprocating assembly 10 and reciprocating engine 140 as represented in FIGS. 1 and 2. All such relative terms are intended to indicate the construction and relative orientations of components and features of the reciprocating assembly 10 and reciprocating engine 140, and therefore are relative terms that are useful to describe the illustrated embodiments but should not be otherwise interpreted as limiting the scope of the invention.

Figure 3:
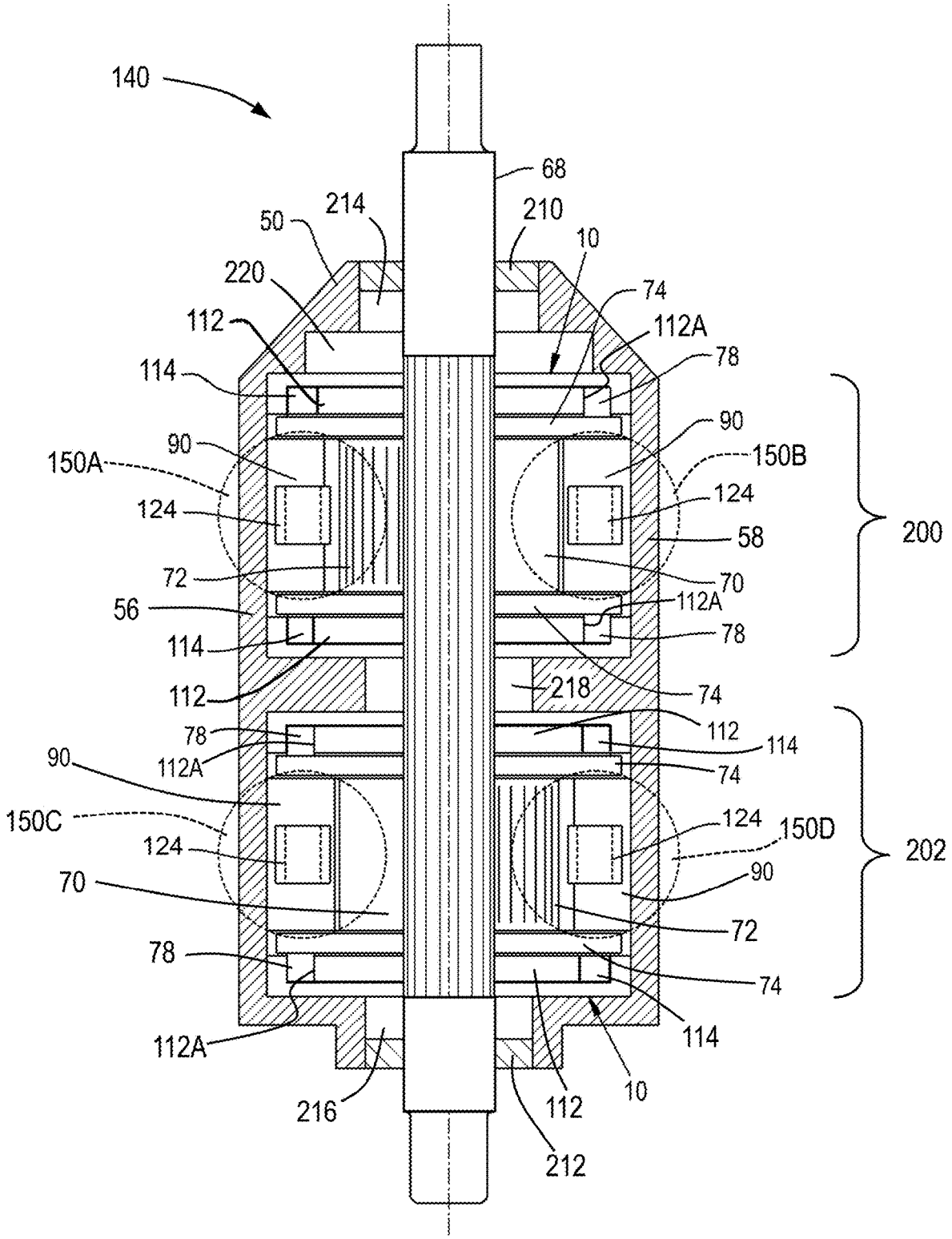

The reciprocating assembly 10 is represented in FIG. 1 as comprising a pinion gear 70, a timing arm 74, a timing plate 112 that defines a timing slot 114, and a dual gear rack 90 in which first and second gear racks 104 and 108 are defined. However, as shown in FIG. 3, a single reciprocating assembly 10 may comprise a single pinion gear 70 and single dual gear rack 90 that are associated with two timing arms 74 and two timing plates 112 each having a timing slot 114. In FIG. 2, a single reciprocating assembly 10 of FIG. 1 is shown associated with a single bank of cylinders 146A-146D and pistons 150A-150D within the mainframe 50 of the engine 140, and in FIG. 3 a pair of reciprocating assemblies 10 is shown associated with two banks of cylinders within the mainframe 50 of the engine 140. (Due to the orientation of the section shown in FIG. 3, only two pistons 150A and 150B of each bank are depicted and the cylinders are unnumbered.) It should be understood from FIG. 3 that the engine 140 may comprise any number of reciprocating assemblies 10 associated with any number of banks of cylinders 146A-146D and pistons 150A-150D.

FIG. 2 depicts the engine mainframe 50 as having an upper wall 52, a lower wall 54, and two sidewalls 56 and 58. FIG. 3 further depicts the engine mainframe 50 as having oppositely-disposed first and second endwalls 60 and 62, which in combination with the upper wall 52, lower wall 54, and sidewalls 56 and 58 define and enclose an interior chamber 64 of the mainframe 50. The engine mainframe 50 serves as an enclosure for internal components of the reciprocating engine 140, including the pinion gear 70, timing arm(s) 74, timing plate(s) 112, and dual gear rack 90 of at least one reciprocating assembly 10 as described in detail below, as well as a suitable lubricant. Within the interior chamber 64 of the engine mainframe 50, the sidewalls 56 and 58 of the mainframe 50 define a parallel pair of slide racks 66 for the single reciprocating assembly 10 visible in FIG. 2. Each slide rack 66 slidably receives one of two oppositely-disposed edges of the dual gear rack 90 of the reciprocating assembly 10. The slide racks 66 serve as guides for the dual gear rack 90, limiting the dual gear rack 90 to a reciprocating motion within a single plane. An output shaft 68 partially resides within the interior chamber 64 of the engine mainframe 50, with opposite ends of the output shaft 68 protruding from the first and second endwalls 60 and 62 of the mainframe 50 (FIG. 3). The engine mainframe 50 and the reciprocating assembly 10 may be constructed from various materials of types known or otherwise capable of use in reciprocating engines, as nonlimiting examples, iron alloys (including steel alloys), aluminum alloys, etc.

The pinion gear 70 of the reciprocating assembly 10 is rigidly attached to the output shaft 68 through any suitable type of connection, such as splines (as shown), a key and keyway, etc. The pinion gear 70 is generally configured to have a circular or disk shape having an outer circumference and pinion teeth 72 disposed along less than half of the outer circumference. A timing arm 74 is also rigidly attached to the output shaft 68 through any suitable type of connection, such as a splines (as shown), a key and keyway, etc., and/or may optionally be coupled to the pinion gear 70. Both the pinion gear 70 and timing arm 74 rotate with the output shaft 68. The timing arm 74 radially extends from the output shaft 68 and terminates at a distal end 76 that is offset from the output shaft 68. A timing pin 78 is disposed at the distal end 76 of the timing arm 74 and extends from the timing arm 74 in a direction approximately parallel to the axis of the output shaft 68. The timing pin 78 resides within the timing slot 114 (whose outer perimeter is shown with broken lines in FIGS. 1, 2, and 4A-4B) and cams against an outer perimeter 112A of the timing plate 112, which is rigidly secured to the dual gear rack 90 so as to reciprocate therewith. The outer perimeter 112A of the timing plate 112 and the timing slot 114 defined thereby are elliptical in shape. Due to its elliptical shape, the timing slot 114 has oppositely-disposed upper and lower vertices 116 and 118 and two oppositely-disposed co-vertices 120 and 122 (FIG. 1). Whereas the timing slot 114 is physically defined at its interior by the outer perimeter 112A of the timing plate 112, the outer perimeter of the slot 114 is physically limited only at its upper and lower vertices 116 and 118 by camming surfaces 100 defined by two ends 92 and 94 of the dual gear rack 90. (The ends 92 and 94 will hereinafter be referred to as end plates 92 and 94, though without the intent or effect of limiting the ends 92 and 94 of the dual gear rack 90 to plates or any other particular structure, other than that the end plates 92 and 94 structural elements that may be coupled to or otherwise form parts of the dual gear rack 90.) As such, the timing slot 114 is configured to retain the timing pin 78 of the timing arm 74 as the output shaft 68 rotates, and assists in controlling the rotation of the pinion gear 70 as more fully described below. The end plates 92 and 94 of the dual gear rack 90 include, respectively, first and second pairs of connecting arm attachments 124 and 126 that are adapted to couple the rack 90 to two or more pistons, such as the pistons 150A-D represented in FIGS. 2, 3, and 4A-D. In the arrangement shown in FIG. 2, with the pistons 150A-150D coupled in pairs to the connecting arm attachments 124 and 126, the pistons 150A and 150B are parallel and move (reciprocate) in parallel unison within their cylinders 146A and 146B, and the pistons 150C and 150D are parallel and move (reciprocate) in parallel unison within their cylinders 146C and 146D.

In addition to the end plates 92 and 94, the dual gear rack 90 includes oppositely-disposed first and second side plates 96 and 98. The dual gear rack 90 and its end plates 92 and 94 and first and second side plates 96 and 98 define a cavity 101 in which the pinion gear 70 and a portion of the output shaft 68 are disposed. The first gear rack 104 resides at the first side plate 96 of the dual gear rack 90 and the second gear rack 108 resides at the second side plate 98 of the dual gear rack 90, and both gear racks 104 and 108 extend in parallel between the first and second end plates 92 and 94 of the dual gear rack 90. Each of the first and second gear racks 104 and 108 have gear rack teeth 106 and 110, respectively, that span at least a portion of the length of its respective gear rack 104 and 108. The gear rack teeth 106 and 110 are configured to engage and mesh with the teeth 72 of the pinion gear 70, though not simultaneously but in alternating sequence, e.g., first the gear rack teeth 106, then the gear rack teeth 110, then the gear rack teeth 106, etc. For this reason, there are no teeth 72 on the pinion 70 that are diametrically opposite each other.

As noted above, a reciprocating engine (such as 140) may utilize any number of the reciprocating assembly 10 of FIG. 1. In FIGS. 2 and 4A-4D, the engine 140 is schematically represented as using a single reciprocating assembly 10 connected to four pistons 150A-150D arranged for reciprocating within four cylinders 146A-146D, respectively, of the reciprocating engine 140, and FIG. 3 schematically represents the engine 140 as using a pair of the reciprocating assembly 10 each connected to four pistons (of which only two, 150A and 150B, are visible) arranged for reciprocating within four cylinders (unnumbered). As will become apparent from the following discussion, the pistons 150A-150D are interconnected through the pinion gear 70 and dual gear rack 90 of the reciprocating assembly 10 in a manner capable of improving the power and efficiency of the reciprocating engine 140 by reducing the loss of torque at the top-dead-center (TDC) position of each piston 150A-150D.

The cylinders 146A-146D are represented in FIG. 2 as being disposed between the sidewalls 56 and 58 of the engine mainframe 50 and closed by the upper and lower walls 52 and 54, which as represented may be cylinder heads of the engine 140 and will be referred to as such in the following discussion. The pistons 150A-150D are individually connected with a connecting rod 152A-152D to a respective connecting arm attachment 124 or 126 of the dual gear rack 90. Each cylinder 146A-146D has a "top" and "bottom" corresponding to the nearest and farthest travel of the pistons 150A-150D relative to the upper or lower cylinder head 52 or 54 that closes their respective cylinder 146A-146D. For example, the pistons 150A and 150B are depicted in FIG. 2 at or near their TDC positions within the respective cylinders 146A and 146B (which, as designated in FIG. 2, corresponds to exhaust and compression cycles if the engine 140 is a four-stroke engine), and the pistons 150C and 150D are depicted in FIG. 2 at or near their BDC positions (corresponding to power and intake cycles of the engine 140). While the operation of a four-stroke combustion engine is indicated in FIG. 2, it should be appreciated that other engines, including but not limited to two-stroke and six-stroke combustion engines and steam engines are also encompassed by the teachings of this invention. The cylinders 146A-146D and pistons 150A-150D may be of any suitable construction and utilize or operate in combination with conventional engine components, including camshafts with conventional timing driven by either gears, chains, or belts, whichever would be applicable depending upon the implementation. Direct overhead cams are also contemplated for servicing each piston 150A-150D. Further, a conventional ignition system is also contemplated depending upon the application.

For purposes of further discussion, FIG. 2 will be described as depicting the pistons 150A and 150B at TDC, i.e., at the top of their respective cylinder 146A and 146B and their nearest location relative to the cylinder head 52, and depicting the pistons 150C and 150D at BDC, i.e., at the bottom of their respective cylinder 146C and 146D and their farthest extent from the cylinder head 54. In the configuration depicted in FIG. 2, the timing pin 78 of the timing arm 74 is at the vertex 118 (FIG. 1) of the timing slot 114, and the teeth 72 of the pinion gear 70 are briefly not engaged with the teeth 106 and 110 of either gear rack 104 or 108. As labeled in FIG. 2, this orientation is configured for combustion to be initiated in the cylinder 146B to cycle the entire reciprocating assembly 10 and its dual gear rack 90 toward the opposite end of the mainframe 50, i.e., toward the cylinder head 54.

As previously noted, FIG. 3 schematically represents a cross-sectional view of the engine 140 of FIG. 2 as comprising two cylinder banks, labeled as 200 and 202. Each bank 200 and 202 comprises a reciprocating assembly 10, four pistons 150A-D (of which only pistons 150A and 150B are visible) within four cylinders 146A-D (unnumbered), etc., as depicted and described for FIG. 2. As was noted previously, each reciprocating assembly 10 depicted in FIG. 3 includes a single pinion gear 70 and single dual gear rack 90 that are associated with two timing arms 74 and two timing plates 112 each having a timing slot 114. The pinion gear 70 and dual gear rack 90 of each reciprocating assembly 10 are between the two timing arms 70 and timing plates 112 of the reciprocating assembly 10 to promote dynamic balancing of the engine 140, though it is foreseeable that other arrangements and balancing techniques could be used.

The reciprocating engine of FIG. 3 depicts the first and second endwalls 60 and 62 and the sidewalls 56 and 58 of the engine mainframe 50. The output shaft 68 extends through the engine mainframe 50 and beyond the first and second endwalls 60 and 62. The endwalls 60 and 62 each include a seal 210 and 212 for retaining a lubricant within the chamber 64 of the engine mainframe 50, and a bearing 214 and 216 located adjacent its respective seal 210 or 212. Directly adjacent the bearing 214 is an oil pump 220. A center bearing 218 is disposed between the first cylinder bank 200 and the second cylinder bank 202.

Figure 4A:
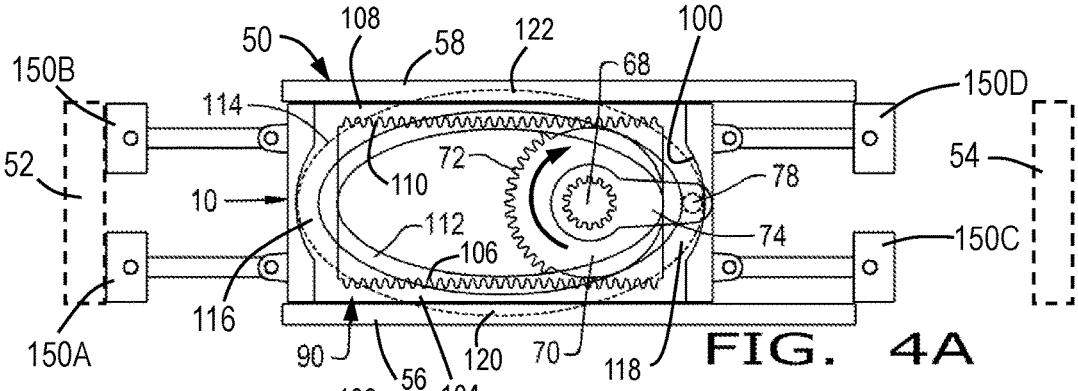
FIGS. 4A through 4D are sectional end views of the reciprocating engine of FIG. 2 at different points of an ignition cycle thereof.

FIGS. 4A through 4D schematically represent different stages of a combustion cycle of the engine 140. The cylinders 146A-146D are omitted for purposes of simplicity of the illustrations. FIG. 4A represents the pistons 150A and 150B at their TDC positions (i.e., at the tops of their respective cylinders 146A and 146B) such that (as evident from FIG. 2 and the location of the mainframe 50 in FIGS. 4A-4D) the dual gear rack 90 is positioned adjacent the cylinder head 52 of the engine mainframe 50. The pistons 150C and 150D are located at their BDC positions (i.e., at the bottoms of their respective cylinders 146C and 146D) such that (as evident from FIG. 2) the dual gear rack 90 is positioned remote from the cylinder head 54 of the engine mainframe 50. In FIG. 4A, the timing pin 78 is at the vertex 118 of the timing slot 114. Additionally, the teeth 72 of the pinion gear 70 are aligned to mesh with the second gear rack teeth 110 of the second gear rack 108. The engagement of the teeth 72 of the pinion gear 70 immediately before and after the pistons 150A and 150B are at TDC and the pistons 150C and 150D are at BDC reduce the loss of torque typically associated with pistons at TDC positions of conventional reciprocating engines.

Figure 4B:
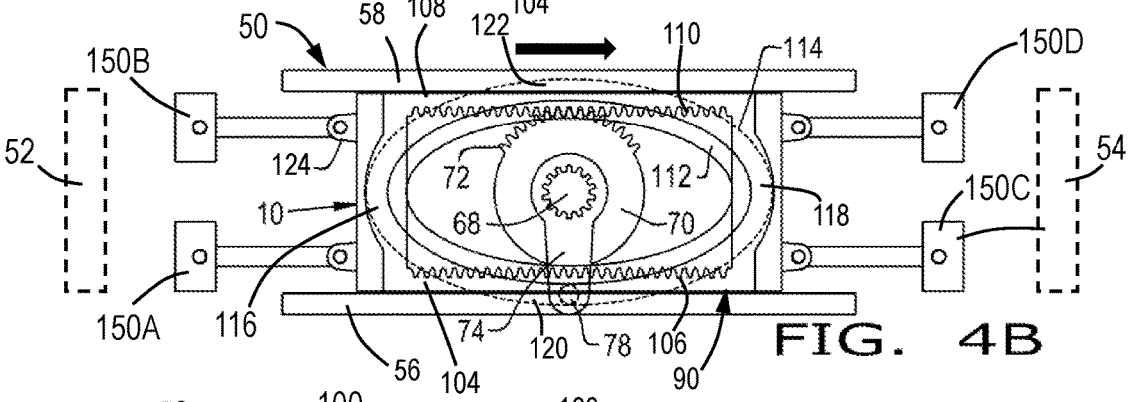

As represented in FIG. 4B, combustion from within either cylinder 146A or 146B associated with the piston 150A or 150B causes the combusted piston 150A or 150B and corresponding connecting rod 152A or 152B to act on the dual gear rack 90, causing the dual gear rack 90 to move in a direction away from the cylinder head 52 toward the lower cylinder head 54 of the engine 140. As the dual gear rack 90 is moved by the piston 150A or 150B, the second gear rack teeth 110 continue to mesh with the teeth 72 of the pinion gear 70 and rotate the pinion gear 70 and the output shaft 68. At the same time, the timing pin 78 of the timing arm 74 travels within the timing slot 114 toward the co-vertex 120 of the timing slot 114. In FIG. 4B, the dual gear rack 90 has traveled approximately halfway toward the lower cylinder head 54 of the engine 140 at a point where the timing pin 78 is located at the co-vertex 120.

Figure 4C:
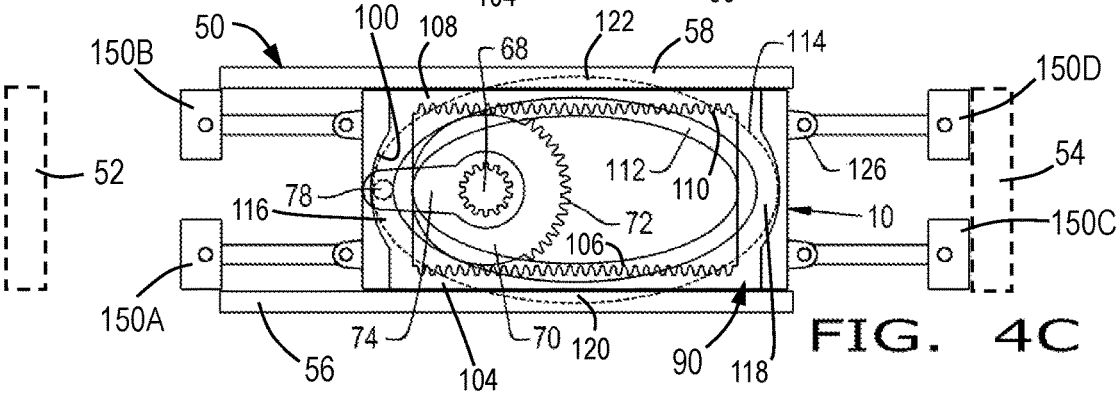

As the combustion cycle continues, the dual gear rack 90 continues to move toward the lower cylinder head 54, causing the pinion gear 70 to rotate the output shaft 68 until the dual gear rack 90 is in proximity of the cylinder head 54 as depicted in FIG. 4C. At this point, the engine 140 is halfway through a single combustion cycle or revolution of the output shaft 68. The pistons 150A and 150B are located at their BDC positions, and the pistons 150C and 150D are located at their TDC positions. In FIG. 4C, the timing pin 78 is at the vertex 116 of the timing slot 114. Additionally, the teeth 72 of the pinion gear 70 are aligned to mesh with the first gear rack teeth 106 of the first gear rack 104. The engagement of the teeth 72 of the pinion gear 70 shortly after the pistons 150C and 150D are at TDC reduce the loss of torque typically associated with pistons at TDC positions of conventional reciprocating engines.

Figure 4D:
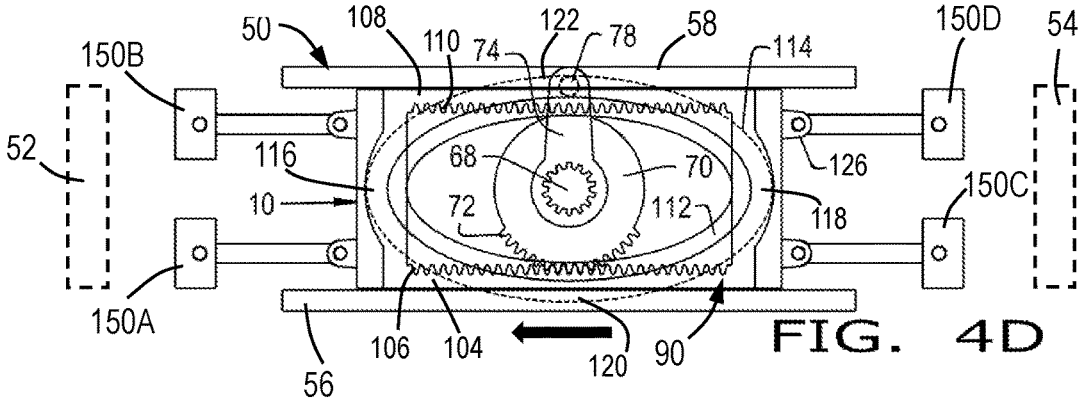

As represented in FIG. 4D, combustion from within either cylinder 146C or 146D associated with the pistons 150C and 150D causes the combusted piston 150C or 150D to act on the dual gear rack 90, causing the dual gear rack 90 to move in a direction away from the lower cylinder head 54 of the engine 140 toward the upper cylinder head 52. As the dual gear rack 90 is moved by the piston 150C or 150D, the first gear rack teeth 106 continue to mesh with the teeth 72 of the pinion gear 70 and rotate the pinion gear 70 and the output shaft 68. At the same time, the timing pin 78 of the timing arm 74 travels within a timing slot 114 toward the co-vertex 122 of the timing slot 114. As depicted in FIG. 4D, the dual gear rack 90 has traveled approximately halfway toward the upper cylinder head 52 of the engine 140 at a point where the timing pin 78 is located at the co-vertex 122.

As evident from the above, during a full combustion cycle the reciprocating engine 140 completes a half-cycle during which the timing pin 78 travels within the timing slot 114 from the co-vertex 120 (FIG. 4B) to the co-vertex 122 (FIG. 4D), the timing arm 74 causes the teeth 72 of the pinion gear 70 that are meshed with the gear rack teeth 110 of the second gear rack 108 to unmesh, rotate, and mesh with the gear rack teeth 106 of the first gear rack 104. Likewise, as the reciprocating engine 140 completes a half-cycle during which the timing pin 78 travels within the timing slot 114 from the co-vertex 122 (FIG. 4D) to the co-vertex 120 (FIG. 4B), the timing arm 74 causes the pinion gear teeth 72 meshed with the teeth 106 of the second gear rack 104 to unmesh, rotate, and mesh with the teeth 110 of the first gear rack 108. The described cycle would continue with combustion in the cylinders 146A and 146B alternating and combustion in the cylinders 146C and 146D also alternating to create a continually operating reciprocating engine 140 that continually rotates the output shaft 68. The output shaft 68 may then be connected to power a desired application.

It is contemplated that the order of the cylinder firing of four pistons coupled to the pinion gear 70 and dual gear rack 90 of the reciprocating assembly 10 represented in the drawings may be (1) the cylinder 146A, (2) the cylinder 146D, (3) the cylinder 146B, and then (4) the cylinder 146C. This series may be considered a single cycle of the reciprocating engine 140. The addition of the second bank 202 of FIG. 3 and associated cylinders would follow the same cycle as described above for the cylinders 146A through 146D. With the cylinders of the second bank 202 arranged and designated in the same manner as the first bank 200, the firing order may be: (1) the cylinder 146B, (2) the cylinder 146C, (3) the cylinder 146A, and (4) the cylinder 146D. In a configuration containing eight cylinders, the simultaneous firing of the first bank 200 and the second bank 202 may be: (1) cylinder 146A of the first bank 200 and cylinder 146B of the second bank 202, (2) cylinder 146D of the first bank 200 and cylinder 146C of the second bank 202, (3) cylinder 146B of the first bank 200 and cylinder 146A of the second bank 202, and (4) cylinder 146C of the first bank 200 and cylinder 146D of the second bank 202.

As previously noted above, though the foregoing detailed description describes certain aspects of one or more particular embodiments of the invention, alternatives could be adopted by one skilled in the art. For example, the reciprocating engine and its components could differ in appearance and construction from the embodiments described herein and shown in the drawings, functions of certain components of the reciprocating engine could be performed by components of different construction but capable of a similar (though not necessarily equivalent) function, and various materials could be used in the fabrication of the reciprocating engine and/or its components. Furthermore, it should be appreciated that certain characteristics of an engine incorporating the reciprocating assembly 10 can be adjusted and tailored by modifying the radii of curvature at the vertices 116 and 118 and co-vertices 12 and 122 of the timing slot 114, for example, by modifying the radii of curvature at the vertices 116 and 118 to modify the acceleration and deceleration characteristics of the pistons 150A-D as they approach and depart from their TDC positions. As such, and again as was previously noted, it should be understood that the invention is not necessarily limited to any particular embodiment described herein or illustrated in the drawings.

The invention claimed is:

1. A reciprocating engine comprising:

an engine mainframe including an upper wall, a lower wall, a first sidewall, and a second sidewall defining an interior chamber of the engine mainframe;

an output shaft extending through the interior chamber and adapted for rotation within the interior chamber;

a pinion gear coupled to the output shaft for rotation with the output shaft, the pinion gear having teeth disposed on a portion of a circumference of the pinion gear;

a timing arm coupled to the output shaft for rotation with the output shaft, the timing arm having a timing pin disposed at a distal end of the timing arm;

a dual gear rack disposed around the output shaft and the pinion gear and configured to reciprocate within the interior chamber of the engine mainframe, the dual gear rack having oppositely-disposed first and second end plates and first and second gear racks between the first and second end plates, the first gear rack having first gear rack teeth configured to mesh with the teeth of the pinion gear and the second gear rack having second gear rack teeth configured to mesh with the teeth of the pinion gear; and a timing plate coupled to the dual gear rack for reciprocating therewith, the timing plate defining a timing slot that has an elliptical shape and is engaged by the timing pin of the timing arm as the timing arm rotates with the output shaft, the elliptical shape of the timing slot having a first vertex at the first end plate of the dual gear rack and a second vertex at the second end plate of the dual gear rack;

wherein the first gear rack teeth are configured to mesh with the teeth of the pinion gear, causing the output shaft to rotate as the dual gear rack moves towards the upper wall of the engine mainframe and the second gear rack teeth are configured to mesh with the teeth of the pinion gear causing the output shaft to continue to rotate as the dual gear rack moves towards the lower wall of the engine mainframe, the timing pin of the timing arm travels within the timing slot as the output shaft rotates, and the teeth of the pinion gear are not engaged with any teeth of the dual gear rack when the timing pin is at the first vertex of the timing slot and when the timing pin is at the second vertex of the timing slot.

2. The reciprocating engine of claim 1, wherein the teeth of the pinion gear are disposed on less than half of the circumference of the pinion gear.

3. The reciprocating engine of claim 1, wherein the timing slot is defined by an outer perimeter of the timing plate.

4. The reciprocating engine of claim 1, wherein the timing pin cams against an outer perimeter of the timing plate, the outer perimeter having an elliptical shape.

5. The reciprocating engine of claim 1, wherein the elliptical shape of the timing slot has a first co-vertex at the first gear rack of the dual gear rack and a second co-vertex at the second gear rack of the dual gear rack.

6. The reciprocating engine of claim 5, wherein when the timing pin is within the timing slot at the first co-vertex the teeth of the pinion gear are engaged with the second gear rack teeth, and when the timing pin is within the timing slot at the second co-vertex the teeth of the pinion gear are engaged with the first gear rack teeth.

7. The reciprocating engine of claim 1, further comprising:

a second timing arm coupled to the output shaft so as to rotate with the output shaft, the second timing arm having a second timing pin disposed at a distal end of the second timing arm; and a second timing plate rigidly secured to the dual gear rack, the second timing plate defining a second timing slot that has an elliptical shape and is engaged by the second timing pin of the second timing arm as the second timing arm rotates with the output shaft.

8. The reciprocating engine of claim 1, wherein the reciprocating engine is a steam engine or an internal combustion engine.

9. The reciprocating engine of claim 8, wherein the reciprocating engine comprises:

at least a first piston coupled to the first end plate of the dual gear rack and disposed in a first cylinder for reciprocation therein; and at least a second piston coupled to the second end plate of the dual gear rack and disposed in a second cylinder for reciprocation therein.

10. The reciprocating engine of claim 9, wherein the reciprocating engine comprises a first cylinder bank comprising the pinion gear, the timing arm, the dual gear rack, the timing plate, the first and second pistons, and the first and second cylinders, and the reciprocating engine comprises a second cylinder bank comprising:

a second pinion gear and a second timing arm coupled to the output shaft so as to rotate with the output shaft, the second pinion gear having teeth disposed about a portion of a circumference of the second pinion gear, the second timing arm having a second timing pin disposed at a distal end of the second timing arm;

a second dual gear rack disposed around the output shaft and the second pinion gear and configured to reciprocate within the interior chamber of the engine mainframe, the second dual gear rack having oppositely-disposed first and second end plates and first and second gear racks between the first and second end plates, the first gear rack of the second dual gear rack having first gear rack teeth configured to mesh with the teeth of the second pinion gear and the second gear rack of the second dual gear rack having second gear rack teeth configured to mesh with the teeth of the second pinion gear; and a second timing plate coupled to the second dual gear rack for reciprocating therewith, the second timing plate defining a second timing slot that has an elliptical shape and is engaged by the second timing pin of the second timing arm as the second timing arm rotates with the output shaft; and at least a third piston coupled to the first end plate of the second dual gear rack and disposed in a third cylinder for reciprocation therein, and at least a fourth piston coupled to the second end plate of the second dual gear rack and disposed in a fourth cylinder for reciprocation therein.

11. The reciprocating engine of claim 9, wherein:

the first piston is at a top-dead-center position within the first cylinder and the second piston is at a bottom-dead-center position within the second cylinder as the timing pin travels through the second vertex of the timing slot, and the second piston is at a top-dead-center position within the second cylinder and the first piston is at a bottom-dead-center position within the first cylinder as the timing pin travels through the first vertex of the timing slot.

12. The reciprocating engine of claim 11, where the first and second vertices of the elliptical shape of the timing slot each have a radius of curvature that determines acceleration and deceleration characteristics of the first and second pistons as they approach and depart from their top-dead-center positions.

13. The reciprocating engine of claim 8, wherein the reciprocating engine comprises:

at least first and second pistons coupled to the first end plate of the dual gear rack and disposed in respective first and second cylinders for reciprocation therein; and at least third and fourth pistons coupled to the second end plate of the dual gear rack and disposed in respective third and fourth cylinders for reciprocation therein.

14. The reciprocating engine of claim 13, wherein:

the first and second pistons are at top-dead-center positions within the first and second cylinders and the third and fourth pistons are at bottom-dead-center positions within the third and fourth cylinders as the timing pin travels through the second vertex of the timing slot, and the third and fourth pistons are at top-dead-center positions within the third and fourth cylinders and the first and second pistons are at bottom-dead-center positions within the first and second cylinders as the timing pin travels through the first vertex of the timing slot.

15. A reciprocating engine comprising:

an engine mainframe including an upper wall, a lower wall, a first sidewall, and a second sidewall defining an interior chamber of the engine mainframe;

an output shaft extending through the interior chamber and adapted for rotation within the interior chamber;

a pinion gear coupled to the output shaft for rotation with the output shaft, the pinion gear having teeth disposed on a portion of a circumference of the pinion gear;

a timing arm coupled to the output shaft for rotation with the output shaft, the timing arm having a timing pin disposed at a distal end of the timing arm;

a dual gear rack disposed around the output shaft and the pinion gear and configured to reciprocate within the interior chamber of the engine mainframe, the dual gear rack having oppositely-disposed first and second end plates and first and second gear racks between the first and second end plates, the first gear rack having first gear rack teeth configured to mesh with the teeth of the pinion gear and the second gear rack having second gear rack teeth configured to mesh with the teeth of the pinion gear; and a timing plate coupled to the dual gear rack for reciprocating therewith, the timing plate defining a timing slot that has an elliptical shape and is engaged by the timing pin of the timing arm as the timing arm rotates with the output shaft;

wherein the first gear rack teeth are configured to mesh with the teeth of the pinion gear, causing the output shaft to rotate as the dual gear rack moves towards the upper wall of the engine mainframe and the second gear rack teeth are configured to mesh with the teeth of the pinion gear causing the output shaft to continue to rotate as the dual gear rack moves towards the lower wall of the engine mainframe, and the timing pin of the timing arm travels within the timing slot as the output shaft rotates;

a second timing arm coupled to the output shaft so as to rotate with the output shaft, the second timing arm having a second timing pin disposed at a distal end of the second timing arm; and a second timing plate rigidly secured to the dual gear rack, the second timing plate defining a second timing slot that has an elliptical shape and is engaged by the second timing pin of the second timing arm as the second timing arm rotates with the output shaft.

16. A reciprocating engine comprising:

an engine mainframe including an upper wall, a lower wall, a first sidewall, and a second sidewall defining an interior chamber of the engine mainframe;

an output shaft extending through the interior chamber and adapted for rotation within the interior chamber;

a pinion gear coupled to the output shaft for rotation with the output shaft, the pinion gear having teeth disposed on less than half of a circumference of the pinion gear;

a timing arm coupled to the output shaft for rotation with the output shaft, the timing arm having a timing pin disposed at a distal end of the timing arm;

a dual gear rack disposed around the output shaft and the pinion gear and configured to reciprocate within the interior chamber of the engine mainframe, the dual gear rack having oppositely-disposed first and second end plates and first and second gear racks between the first and second end plates, the first gear rack having first gear rack teeth configured to mesh with the teeth of the pinion gear and the second gear rack having second gear rack teeth configured to mesh with the teeth of the pinion gear; and a timing plate coupled to the dual gear rack for reciprocating therewith, the timing plate defining a timing slot that has an elliptical shape and is engaged by the timing pin of the timing arm as the timing arm rotates with the output shaft;

wherein the first gear rack teeth are configured to mesh with the teeth of the pinion gear, causing the output shaft to rotate as the dual gear rack moves towards the upper wall of the engine mainframe and the second gear rack teeth are configured to mesh with the teeth of the pinion gear causing the output shaft to continue to rotate as the dual gear rack moves towards the lower wall of the engine mainframe, and the timing pin of the timing arm travels within the timing slot as the output shaft rotates.

* * * * *